US008497808B2

(12) United States Patent
Wang

(10) Patent No.: US 8,497,808 B2
(45) Date of Patent: Jul. 30, 2013

(54) ULTRA-WIDEBAND MINIATURIZED OMNIDIRECTIONAL ANTENNAS VIA MULTI-MODE THREE-DIMENSIONAL (3-D) TRAVELING-WAVE (TW)

(75) Inventor: Johnson J. H. Wang, Marietta, GA (US)

(73) Assignee: Wang Electro-Opto Corporation, Marietta, GA (US)

( * ) Notice: Subject to any disclaimer, the term of this patent is extended or adjusted under 35 U.S.C. 154(b) by 292 days.

(21) Appl. No.: 13/082,744

(22) Filed: Apr. 8, 2011

(65) Prior Publication Data

US 2012/0256799 A1 Oct. 11, 2012

(51) Int. Cl.
*H01Q 11/02* (2006.01)

(52) U.S. Cl.
USPC ..... 343/737; 343/834

(58) Field of Classification Search
USPC ..... 343/737, 729, 834, 846
See application file for complete search history.

(56) References Cited

U.S. PATENT DOCUMENTS

| | | | | |
|---|---|---|---|---|
| 4,112,431 | A | 9/1978 | Wild | |
| 5,313,216 | A | 5/1994 | Wang et al. | |
| 5,453,752 | A | 9/1995 | Wang et al. | |
| 5,546,096 | A * | 8/1996 | Wada | 343/771 |
| 5,589,842 | A | 12/1996 | Wang et al. | |
| 5,621,422 | A | 4/1997 | Wang | |
| 6,137,453 | A | 10/2000 | Wang et al. | |
| 6,509,873 | B1 * | 1/2003 | Nalbandian et al. | 343/700 MS |
| 6,972,729 | B2 * | 12/2005 | Wang | 343/833 |
| 7,106,270 | B2 | 9/2006 | Igusa et al. | |
| 7,545,335 | B1 | 6/2009 | Wang | |
| 8,264,410 | B1 * | 9/2012 | Wang | 343/700 MS |
| 2008/0316124 | A1 | 12/2008 | Hook | |

OTHER PUBLICATIONS

Chu, L. J., "Physical Limitations of Omnidirectional Antennas," J. Appl. Phys, vol. 19, Dec. 1948.

Deschamps, G. A., "Impedance Properties of Complementary Multiterminal Planar Structure," IEEE Trans. Antennas and Prop., vol. 7, No. 5, pp. S371-S378, Dec. 1969.

DuHamel, H. D. and Scherer, J. P., "Frequency Independent Antennas," in Antenna Engineering Handbook, 3rd. Edition, R. C. Johnson, Editor, McGraw-Hill, New York, 1993.

Goubau, G., "Multi-Element Monopole Antennas," Proc. Army ECOM-ARO, Workshop on Electrically Small Antennas, Ft. Monmouth, NJ., pp. 63-67, May 1976.

(Continued)

*Primary Examiner* — Ahshik Kim
(74) *Attorney, Agent, or Firm* — Thomas | Horstemeyer, LLP

(57) ABSTRACT

A class of ultra-wideband miniaturized traveling-wave (TW) antennas comprising a conducting ground surface at the base, a plurality of TW structures having at least one ultra-wideband low-profile two-dimensional (2-D) surface-mode TW structure, a frequency-selective coupler placed between adjacent TW structures, and a feed network. In one embodiment, a 2-D surface-mode TW structure is positioned above the conducting ground surface, a normal-mode TW structure placed on top with an external frequency-selective coupler placed in between; continuous octaval bandwidth of 14:1 and size reduction by a factor of 3 to 5 are achievable. In other embodiments using at least two 2-D TW structures and a dual-band feed network, a continuous bandwidth over 100:1, and up to 140:1 or more, is reachable. In yet another embodiment, ultra-wideband multi-band performance over an octaval operating bandwidth up to 2000:1 or more is feasible.

24 Claims, 13 Drawing Sheets

OTHER PUBLICATIONS

Mattaei, G., Young, L., and Jones, E.M.T., Microwave Filters, Impedance-Matching Networks and Coupling Structures, McGraw-Hill, New York, 1964. Reprinted by Artech House, Norwood, MA, 1985.
Walter, C. H., "Traveling Wave Antennas," McGraw-Hill, New York, NY, 1965.
Wang, J. J. H., "Generalized Moment Methods in Electromagnetics—Formulation and Computer Solution of Integral Equations," Wiley, New York, 1991, pp. 103-105 and 165-175.
Wang, J. J. H., "The Spiral as a Traveling Wave Structure for Broadband Antenna Applications," Electromagnetics, pp. 20-40, Jul.-Aug. 2000.
Wang, J. J. H., "A Critique and New Concept on Gain Bandwidth Limitation of Omnidirectional Antennas," Progress in Electromagnetics Research Symposium (PIERS) 2005, Hangzhou, China, Aug. 2005.
Wang, J. J. H., "Fundamental Bandwidth Limitation for Small Antennas on a Platform," 2006 IEEE International Workshop on Antenna Technology: Small Antennas and Novel Metamaterials (IWAT 2006), White Plains, New York, Mar. 2006.
Wang, J. J. H. , Triplett, D. J., and Stevens, C. J., "Broadband/Multiband Conformal Circular Beam-Steering Array," IEEE Trans. Antennas and Prop. vol. 54, No. 11, pp. 3338-3346, Nov. 2006.
Wang, J. J. H. and Tripp, V. K., "Design of Multioctave Spiral-Mode Microstrip Antennas," IEEE Trans. Ant. Prop, Mar. 1991.
Mayes, P.E., "Frequency Independent Antennas," in Atenna Handbook, Y.T. Lo and S.W. Lee, Editors, Van Nostrand Reinhold, NY, 1988, Chapter 9.
Morgan, George Emir, et al., "New Bands, New Rules, New Technologies; The Current State of the Wireless Industry", Advancing Microelectronics,(1998 Special Wireless Issue), vol. 25, No. 3,pp. 9-16, 1998.
King, Ronold, et al., "Transmission-Line Missile Antennas," IRE Transactions on Antennas and Propagation, vol. 8, No. 1, pp. 88-90, Jan. 1960.

* cited by examiner

A-A Cross-sectional View

Perspective View

Bottom View

ULTRA-WIDEBAND MINIATURIZED OMNIDIRECTIONAL ANTENNAS VIA MULTI-MODE THREE-DIMENSIONAL (3-D) TRAVELING-WAVE (TW)

TECHNICAL FIELD

The present invention is generally related to radio-frequency antennas and, more particularly, miniaturized low-profile ultra-wideband omnidirectional antennas.

BACKGROUND

Omnidirectional antennas, such as the common dipole and whip antennas, are the most widely used antennas. The omnidirectional antenna in the ideal case has a uniform radiation intensity about a center axis of the antenna, peaked in the plane perpendicular to the center axis. For example, the vertical dipole is an omnidirectional antenna with a uniform (constant) radiation intensity about its vertical axis (i.e., in the azimuth pattern) at any given elevation angle, and peaked at the horizontal plane.

In some modern practical applications, the class of omnidirectional antennas is broadened to include those with broad spatial coverage substantially symmetrical about a vertical axis over a span of elevation angles (mostly near the horizon in the context of terrestrial applications). However, some directionality or even nulls may be acceptable or even preferred in certain applications, especially in the digital wireless world. Nevertheless, the techniques in this disclosure provide for a substantially uniform azimuth pattern over a given span of elevation angles. In the elevation pattern, some beam tilt is generally unavoidable, and may be preferred in certain applications.

The proliferation of wireless applications is setting increasingly more demanding goals for wider bandwidth, lower profile, smaller size and weight, as well as lower cost for omnidirectional antennas. To achieve these physical and performance goals, the antenna engineer must overcome the Chu limit (Chu, L. J., "Physical Limitations of Omnidirectional Antennas," *J. Appl. Phys.*, Vol. 19, December 1948, which is incorporated herein by reference), which states that the gain bandwidth of an antenna is limited by the electrical size (namely, size in wavelength) of the antenna.

Specifically, under the Chu limit, if an antenna is to have good efficiency and fairly large bandwidth, at least one of its dimensions needs to be about $\lambda_L/4$ or larger, where $\lambda_L$ denotes the wavelength at the lowest frequency of operation. At frequencies UHF and lower (below 1 GHz), the wavelength is longer than 30 cm, where the size of the antenna becomes an increasingly serious problem with decreasing frequencies (thus longer wavelengths). For example, to cover a high frequency band, say, 3-30 MHz, a broadband efficient antenna may have to be as huge as 15 m tall and 30 m in diameter.

To circumvent the Chu limit, one approach is to reduce the antenna height and trade it with larger dimensions parallel to the surface of the platform on which the antenna is mounted, resulting in a low-profile antenna. For example, when an antenna is mounted on a platform, such as the cell phone, or the earth ground, the platform becomes part of the antenna radiator, leading to a larger dimension for the antenna needed to satisfy the Chu limit. In many applications, low profile and wide bandwidth, such as "ultra-wideband," have become common antenna requirements.

An "ultra-wideband" antenna is generally meant to have an octaval gain bandwidth greater than 2:1, that is, $f_H/f_L \geqq 2$, where $f_H$ and $f_L$ are the highest and lowest frequencies of operation. Note that "ultra-wideband" is sometimes meant in practice to have two or more wide frequency bands (multi-band) with each band having an adequately wide bandwidth. A "low-profile" antenna is generally meant to have a height of $\lambda_L/10$ or less, where $\lambda_L$ is the free-space wavelength at $f_L$.

In the pursuit of wider bandwidth and lower profile, the traveling-wave (TW) antenna with its TW propagating along the surface of the platform was found to have not only an inherently lower profile but also potentially wider bandwidth. (The TW antenna is an antenna for which the fields and current that produce the antenna radiation pattern may be represented by one or more TWs, which are electromagnetic waves that propagate with a certain phase velocity, as discussed in the book "Traveling Wave Antennas" (Walter, C. H., *Traveling Wave Antennas*, McGraw-Hill, New York, N.Y., 1965, which is incorporated herein by reference), in which a number of low-profile TW antennas were discussed.)

Certain traveling-wave (TW) antennas, in which the TW travels either along or perpendicular to the surface of the platform, can have not only an inherently low profile but also potentially wide bandwidth. Further, the fields and current of certain TW antennas can produce an antenna radiation pattern that may be represented by one or more TWs.

FIG. 1 illustrates the progress of the omnidirectional TW (traveling wave) antenna toward broader bandwidth, miniaturization, and platform conformability in the prior art. The first stage, from (a) to (b), shows an early example of reduction in antenna profile. Here the high-profile whip antenna mounted on a platform is reduced to a low-profile transmission-line antenna (King, R. W. P., C. W. Harrison, Jr., and D. H. Denton, Jr. "Transmission-line missile antennas," *IEEE Transactions on Antennas and Propagation*, vol. 8, No. 1, pp. 88-90. January 1960, which is incorporated herein by reference). Note that the whip antenna can be considered as a TW antenna, and specifically a 1-dimensional (1-D) normal-mode TW antenna. In effect, here the technique was to replace the high-profile normal-mode TW structure or source field with a low-profile 1-D transmission-line antenna, which is a 1-D surface-mode TW that provides a similar omnidirectional pattern coverage and vertical polarization like the vertical whip antenna.

While the 1-D surface-mode TW in the transmission-line antenna propagates in a path parallel to the ground plane (in other words, perpendicular to the z axis), its radiating current is mainly on one or more of its vertical posts parallel to the z axis with equivalent currents that are close to each other in phase from a relevant far-field perspective. Note that this 1-D surface-mode TW and its supporting structure do not have to be along a straight radial line about the z axis. For instance, the 1-D surface TW structure can be bent and curved in the x-y plane as long as the general characteristics of its 1-D transmission-line mode TW remain substantially intact and undisturbed.

However, the 1-D transmission-line antenna is inherently a narrow-band antenna. In general, only a few percent in bandwidth is achieved. Additionally, a lower antenna profile results in a smaller bandwidth. Several 2-D low-profile TW antennas exhibiting increasingly broader bandwidths, such as disk-loaded monopoles, blade antennas, etc. were then developed, as depicted in (b) to (c) of FIG. 1. Among them, the pillbox-shaped Goubau antenna (Goubau, G., "Multi-Element Monopole Antennas," Proc. Army ECOM-ARO, Workshop on Electrically Small Antennas, Ft. Monmouth, N.J., pp. 63-67, May 1976, which is incorporated herein by reference) has a 2:1 bandwidth and a low profile of 0.065 $\lambda_L$ in height (thickness), being nearest to the Chu limit. The spiral-mode microstrip (SMM) antennas, a class of 2-D TW antenna, represent a significant improvement in broadening the bandwidth and lowering the profile of the TW antennas, as shown in publications (Wang, J. J. H. and V. K. Tripp, "Design of Multioctave Spiral-Mode Microstrip Antennas," *IEEE Trans. Ant. Prop*, March 1991; Wang, J. J. H., "The Spiral as a Traveling Wave Structure for Broadband Antenna Applications," *Electromagnetics, pp.* 20-40, July-August 2000; Wang, J. J. H, D. J. Triplett, and C. J. Stevens, "Broadband/Multiband Conformal Circular Beam-Steering Array," *IEEE Trans. Antennas and Prop.* Vol. 54, Nol. 11, pp. 3338-3346, November, 2006) and (U.S. Pat. Nos. 5,313,216, issued in 1994; 5,453,752, issued in 1995; 5,589,842, issued in 1996; 5,621,422, issued in 1997; 7,545,335 B1, issued in 2009), which are all incorporated herein by reference. The omnidirectional mode-0 SMM antenna has achieved practical octaval bandwidths of 10:1 or so and has an antenna height of about 0.09 $\lambda_L$ and a diameter under $\lambda_L/2$. In the above examples, the Chu limit sets the lower bound of the operating frequency for an efficient antenna of a given electrical size, not its gain bandwidth.

A technique to reduce the size of a 2-D surface TW antenna is to reduce the phase velocity, thereby reducing the wavelength, of the propagating TW. This leads to a miniaturized slow-wave (SW) antenna (Wang and Tillery, U.S. Pat. No. 6,137,453 issued in 2000, which is incorporated herein by reference), which allows for a reduction in the antenna's diameter and height, with some sacrifice in performance.

The SW antenna is a sub-class of the TW antenna, in which the TW is a slow-wave with the resulting reduction of phase velocity characterized by a slow-wave factor (SWF). The SWF is defined as the ratio of the phase velocity $V_s$ of the TW to the speed of light c, given by the relationship $$\mathrm{SWF}=c/V_s=\lambda_o/\lambda_s \quad (1)$$

where c is the speed of light, $\lambda_o$ is the wavelength in free space, and $\lambda_s$ is the wavelength of the slow-wave, at the operating frequency $f_o$. Note that the operating frequency $f_o$ remains the same both in free space and in the slow-wave antenna. The SWF indicates how much the TW antenna is reduced in a relevant linear dimension. For example, an SW antenna with an SWF of 2 means its linear dimension in the plane of SW propagation is reduced to ½ of that of a conventional TW antenna. Note that, for size reduction, it is much more effective to reduce the diameter, rather than the height, since the antenna size is proportional to the square of antenna diameter, but only linearly to the antenna height. Note also that in this disclosure, whenever TW is mentioned, the case of SW is generally included.

With the proliferation of wireless systems, antennas are required to have increasingly broader bandwidth, smaller size/weight/foot-print, and platform-conformability, especially for frequencies UHF and below (i.e., lower than 1 GHz). Additionally, for applications on platforms with limited space and carrying capacity, reductions in volume, weight, and the generally consequential fabrication cost considerably beyond the state of the art are highly desirable and even mandated in some applications.

DETAILED DESCRIPTION OF THE INVENTION DISCLOSURE

This disclosure shows techniques using multi-mode 3-D (three-dimensional) TW (traveling-wave), together with wave coupling and feeding techniques, to broaden the bandwidth and reduce the size/weight/foot-print of platform-conformable omnidirectional antennas, resulting in physical merits and electrical performance beyond the state of the art by a wide margin.

Figure 1:
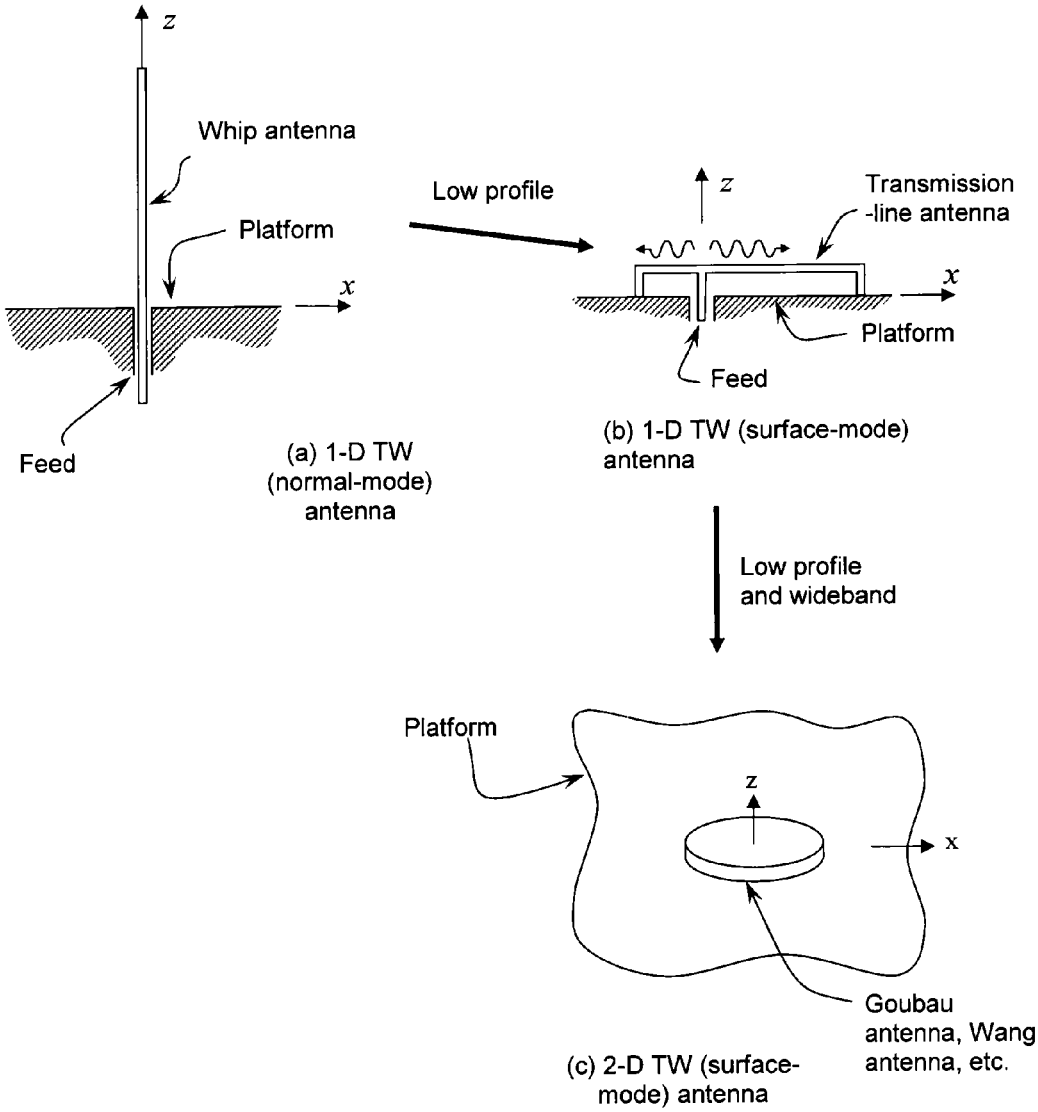
FIG. 1 (Prior Art)
FIG. 1 illustrates prior art in the advance of omnidirectional antennas toward broad bandwidth, low profile and miniaturization.
Figure 2:
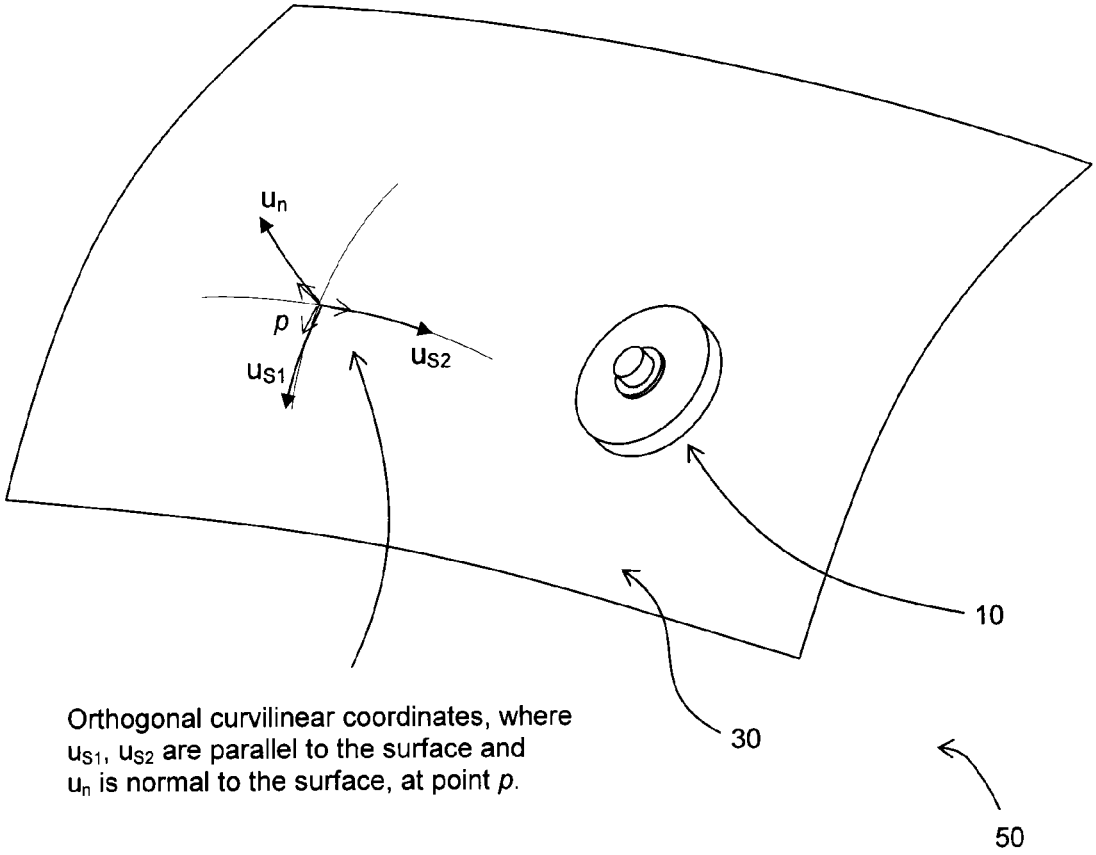
FIG. 2 shows one embodiment of an ultra-wideband low-profile miniaturized 3-D TW antenna mounted on a generally curved surface of a platform.

Referring now to FIG. 2, depicted is a 3-D (three-dimensional) multi-mode TW (traveling-wave) antenna 10 mounted on the generally curved surface of a platform 30, the antenna/platform assembly is collectively denoted as 50 in recognition of the interaction between the antenna 10 and its mounting platform 30, especially when the dimensions of the antenna are small in wavelength. The antenna is conformally mounted on the surface of a platform, which is generally curvilinear, as depicted by the orthogonal coordinates, and their respective tangential vectors, at a point p. As a practical matter, the antenna is often placed on a relatively flat area on the platform, and does not have to perfectly conform to the surface since the TW antenna has its own conducting ground surface. Thus, the conducting ground surface is generally chosen to be part of a canonical shape, such as a planar, cylindrical, spherical, or conical shape, that is easy and inexpensive to fabricate.

At an arbitrary point p on the surface of the platform, orthogonal curvilinear coordinates $u_{s1}$ and $u_{s2}$ are parallel to the surface, and $u_n$ is perpendicular to the surface. A TW propagating in a direction parallel to the surface, that is, perpendicular to $u_n$, is called a surface-mode TW. If the path of a surface-mode TW is along a narrow path, not necessarily linear or straight, the TW is 1-D (1-dimensional). Otherwise the surface-mode TW's path would be 2-D (2-dimensional), propagating radially and preferably evenly from the feed and radiating outwardly along the platform surface, resulting in an omnidirectional radiation pattern, with vertical polarization (parallel to $u_n$).

While discussions in the present disclosure are carried out in either transmit or receive case, the results and conclusions are valid for both cases on the basis of the theory of reciprocity since the TW antennas discussed here are made of linear passive materials and parts.

Figure 3:
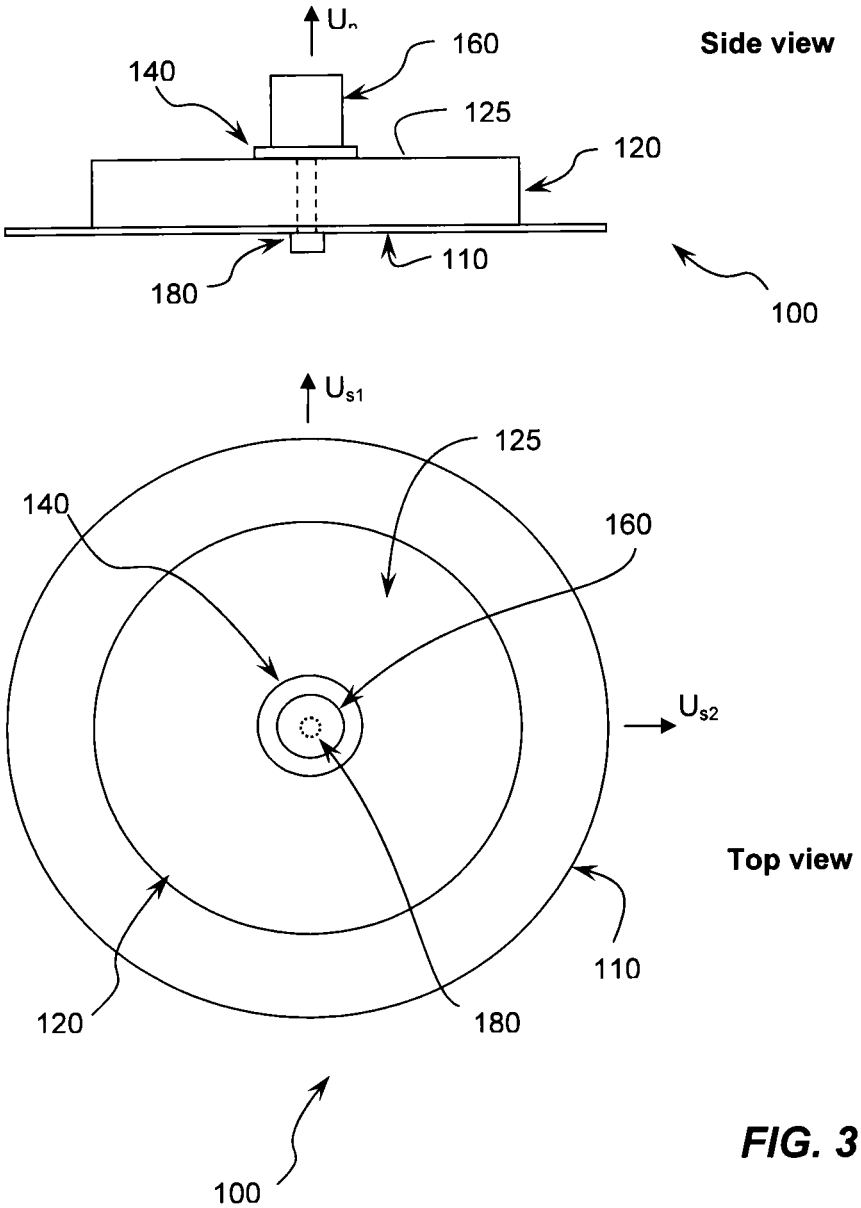
FIG. 3 illustrates one embodiment of an ultra-wideband low-profile miniaturized 3-D TW antenna including a 2-D surface-mode structure and a 1-D normal-mode structure.

As depicted in FIG. 3, in side and top views, one embodiment of this 3-D multimode TW antenna 100 includes a conducting ground plane 110, a 2-D surface-mode TW structure 120, a frequency-selective external coupler 140, and a 1-D normal-mode TW structure 160, stacked, one on top of the other, sequentially. The antenna is fed at the center of the bottom by a feed network 180, which protrudes into the 2-D surface-mode TW structure 120. Since this is an omnidirectional antenna, each component in FIG. 3 is configured in the shape of a pillbox with a circular or polygonal perimeter. Further, each component is structurally symmetrical about the vertical coordinate $u_n$ in order to generate a radiation pattern symmetrical about $u_n$, even though each component of the 3-D multimode TW antenna 100 is depicted only as a concentric circular form in the top view shown in FIG. 3. All pillbox-shaped components are parallel to the conducting ground plane 110, which can be part of the surface of a canonical shape such as a plane, a cylinder, a sphere, or a cone. Also, the thickness of each TW structure is electrically small, generally less than 0.1 $\lambda_L$, where $\lambda_L$ denotes the wavelength at the lowest frequency of operation. Additionally, while the preferred 2-D TW structure 120 is symmetrical about a center axis of the antenna, it can be reconfigured to have an elongated shape in order to conform to certain platforms.

The conducting ground plane 110 is an inherent and innate component, and has dimensions at least as large as those of the bottom, of the ultra-wideband low-profile 2-D surface-mode TW structure 120. In one embodiment, the conducting ground plane 110 has a surface area that covers at least the projection on the platform, in the direction of $-u_n$, from the 3-D TW antenna 100 with its conducting ground plane 110 excluded or removed. Since the top surfaces of many platforms are made of conducting metal, they can serve directly as the conducting ground plane 110, if needed. The 2-D surface-mode TW structure 120 is less than $\lambda_L/2$ in diameter, where $\lambda_L$ is the wavelength at the lowest frequency of the individual operating band of the 2-D surface-mode TW structure 120 by itself. The individual operating band of the 2-D surface-mode TW structure 120 alone may achieve an octaval bandwidth of 10:1 or more by using, for example, a mode-0 SMM (Spiral-Mode Microstrip) antenna. The 1-D normal-mode TW structure 160 supports a TW propagating along the vertical coordinate $u_n$. Its function is to extend the lower bound of the individual operating frequencies of the 2-D surface-mode TW structure 120. In one embodiment, the TW structure 160 is a small conducting cylinder with an optimized diameter and height.

The 2-D surface-mode TW radiator 125, as part of the 2-D surface-mode TW structure 120, may be a planar multi-arm self-complementary Archimedean spiral excited in mode 0 (in which the equivalent current source at any radial distance from the vertical coordinate $u_n$ is substantially equal in amplitude and phase and of $\phi$ polarization in a spherical coordinate system with $u_n$ being the z axis), specialized to adapt to the application. In other embodiments, the 2-D surface-mode TW radiator 125 is configured to be a different planar structure, preferably self-complementary, as will be discussed in more details later, and excited in mode 0. It is worth noting that the TW radiator 125 is preferably open at the outer rim of the 2-D surface-mode TW structure 120, serving as an additional annular slot that contributes to omnidirectional radiation.

The frequency-selective external coupler 140 is a thin planar conducting structure, which is placed at the interface between the 2-D surface-mode TW structure 120 and the 1-D normal-mode TW structure 160 and optimized to facilitate and regulate the coupling between these adjacent TW structures. Throughout the individual frequency band of the 2-D surface-mode TW structure 120 (generally over a bandwidth of a 10:1 ratio or more and at the higher end of the operating frequency range of the 3-D multimode TW antenna 100), the frequency-selective external coupler 140 suppresses the interference of the 1-D normal-mode TW structure 160 to the 2-D surface-mode TW structure 120. On the other hand, the frequency-selective external coupler 140 facilitates the coupling of power, at the lower end of the operating frequency band of the 3-D multimode TW antenna 100, between the 2-D surface-mode TW structure 120 and the 1-D normal-mode TW structure 160. In one embodiment, the external coupler 140 is made of conducting materials and has a dimension large enough to cover the base (bottom) of the 1-D normal-mode TW structure 160. Simultaneously, the external coupler 140 may be optimized to minimize its impact and the impact of the 1-D normal-mode TW structure 160 on the performance of the 2-D surface-mode TW structure 120 throughout the individual operating band of the 2-D surface-mode TW structure 120. In one embodiment, the external coupler 140 is a circular conducting plate with its diameter optimized under the constraints described above and for the specific performance requirements.

The optimization of the 2-D surface-mode TW structure 120 and the frequency-selective external coupler 140 is a tradeoff between the desired electrical performance and the physical and cost parameters for practicality of the specific application. In particular, while ultra-wide bandwidth and low profile may be desirable features for antennas, in many applications the 2-D TW antenna's diameter, and its size proportional to the square of its diameter, become objectionable, especially at frequencies UHF and below (i.e., lower than 1 GHz). For example, at frequencies below UHF the wavelength is over 30 cm, and an antenna diameter of $\lambda_L/3$ may be over 10 cm; any antenna larger in diameter would be viewed negatively by users. Thus, for applications on platforms with limited space and carrying capacity, miniaturization and weight reduction are desirable. In one embodiment, from the perspective of antenna miniaturization, size reduction by a factor of 3 to 5 may be achieved by reducing the diameter of the 2-D surface-mode TW structure 120 while maintaining its coverage at lower frequencies by using the 1-D normal-mode TW structure 160. From the perspective of broadbanding, the 10:1 octaval bandwidth of the simple 2-D TW antenna is broadened to 14:1 or more at a small increase in volume and weight when the 1-D normal-mode TW structure 160 is added. Additionally, a cost reduction by a factor of 3 to 6 also follows as a result of savings in materials, especially at frequencies UHF and below.

The antenna's feed network 180 consists of a connector and an impedance matching structure which is included in the 2-D surface-mode TW structure 120, and which is a microwave circuit that excites the desired mode-0 TW in the surface-mode radiator 125. Additionally, the antenna feed network 180 also matches the impedance of the TW structure 120 on one side and that of the external connector, typically 50 ohms, on the other. The mode to be excited is preferably mode 0, but may also be mode 2 or higher.

The theory and techniques for the impedance matching structure for broadband impedance matching are well established in the field of microwave circuits which can be adapted to the present application. It must be pointed out that the requirement of impedance matching must be met for each mode of TW. For instance, impedance matching must be met for each mode if there are two or more modes that are to be employed for multimode, multifunction, or pattern/polarization diversity operations by the antenna.

While the 2-D surface-mode TW radiator 125 takes the form of a planar multi-arm self-complementary Archimedean spiral in one embodiment as discussed, it is in general an array of slots which generate omnidirectional radiation patterns, having substantially constant resistance and minimal reactance over an ultra-wide bandwidth, typically up to 10:1 or more in octaval bandwidths. (A planar multi-arm self-complementary spiral, Archimedean or equiangular, is one embodiment of an array of concentric annular slots.) The radiation at the TW surface-mode radiator 125 in mode-0 TW is from the concentric arrays of slots, which are equivalent to concentric arrays of annular slots, magnetic loops, or vertical electric monopoles. The radiation takes place at a circular radiation zone about a normal axis $u_n$ at the center of the 2-D surface-mode TW radiator 125, as well as at the edge of the radiator 125.

Figure 4:
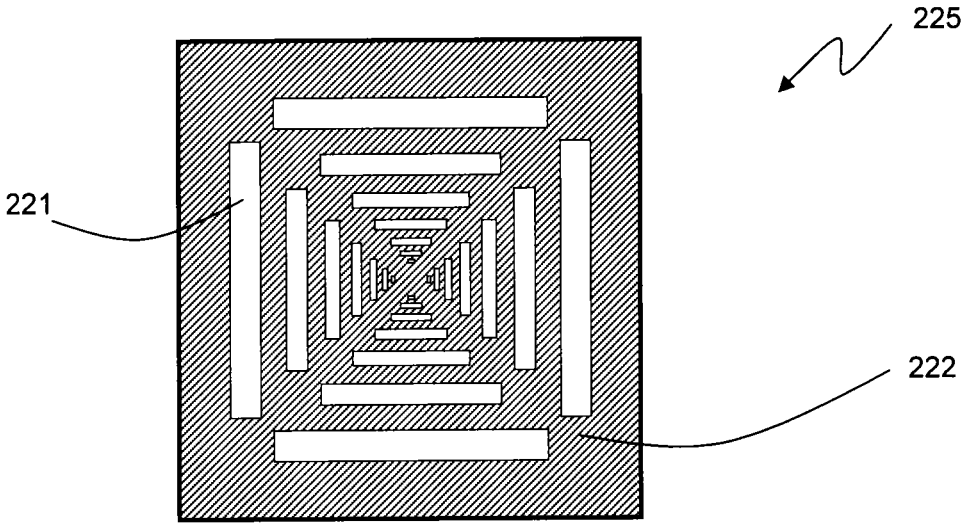
FIG. 4 shows one embodiment of a planar broadband array of slots as another mode-0 TW radiator.
Figure 5A:
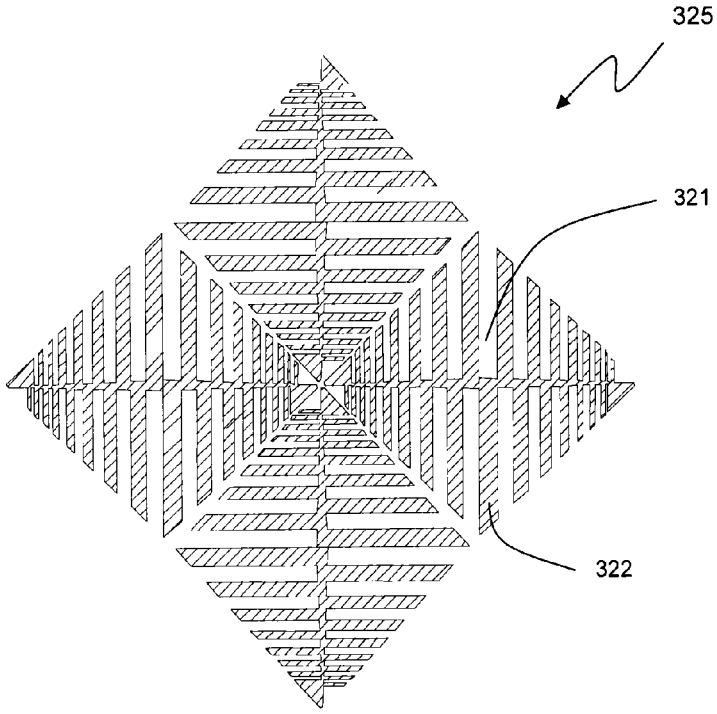
FIG. 5A shows one embodiment of a square planar log-periodic array of slots as another mode-0 TW radiator.
Figure 5B:
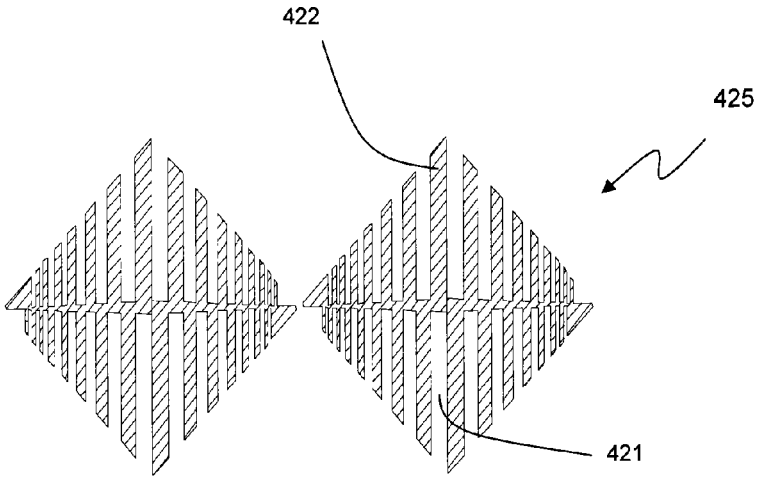
FIG. 5B shows one embodiment of an elongated planar log-periodic structure as another mode-0 TW radiator.
Figure 6A:
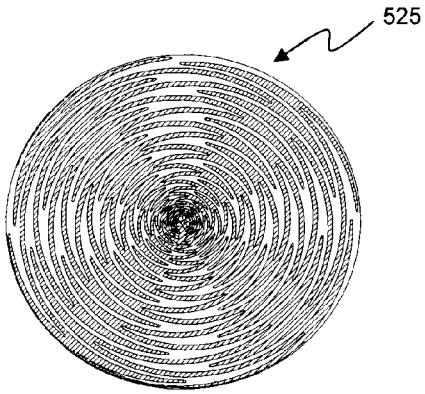
FIG. 6A shows one embodiment of a circular planar sinuous structure as another mode-0 TW radiator.
Figure 6B:
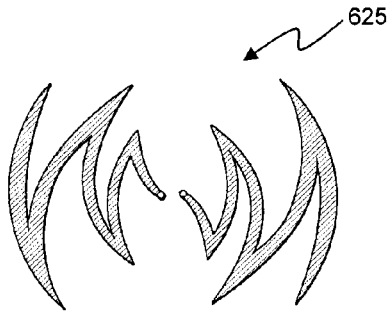
FIG. 6B shows one embodiment of a zigzag planar structure as another mode-0 TW radiator.
Figure 6C:
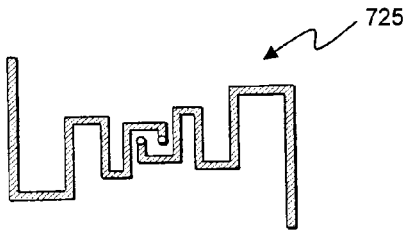
FIG. 6C shows one embodiment of an elongated planar log-periodic structure as another mode-0 TW radiator.
Figure 6D:
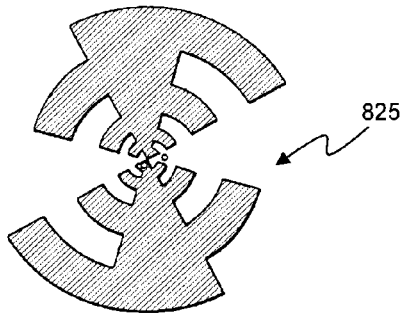
FIG. 6D shows one embodiment of a planar log-periodic self-complementary structure as another mode-0 TW radiator.

FIG. 4 shows another embodiment of a planar 2-D TW radiator 225, which may be preferred in certain applications over the planar multi-arm self-complementary spiral as a TW radiator 125. It consists of an array of slots 221, which is an array of concentric subarrays of slots; each subarray of four slots is equivalent to an annular slot. The hatched region 222 is a conducting surface that supports the slots. FIGS. 5A-5B and 6A-6D show additional embodiments of the 2-D TW radiators 225. FIG. 5A shows a 2-D TW radiator 325 having an array of slots 321 and a conducting surface 332 as the hatched region. Additionally, FIG. 5B shows a 2-D TW radiator 425 having an array of slots 421 and a conducting surface 422 as the hatched region. In addition, FIGS. 6A-6D show additional embodiments of the 2-D TW radiators 525, 625, 725, and 825, respectively. While most of the 2-D TW radiator 125, and thus the TW structure 120, are symmetrical about a center axis of the antenna, they can be reconfigured to have an elongated shape in order to conform to certain platforms. These configurations provide additional diversity to the 2-D surface-mode TW radiator 125 capable of ultra-wide bandwidth and other unique features desired in certain applications.

Figure 7:
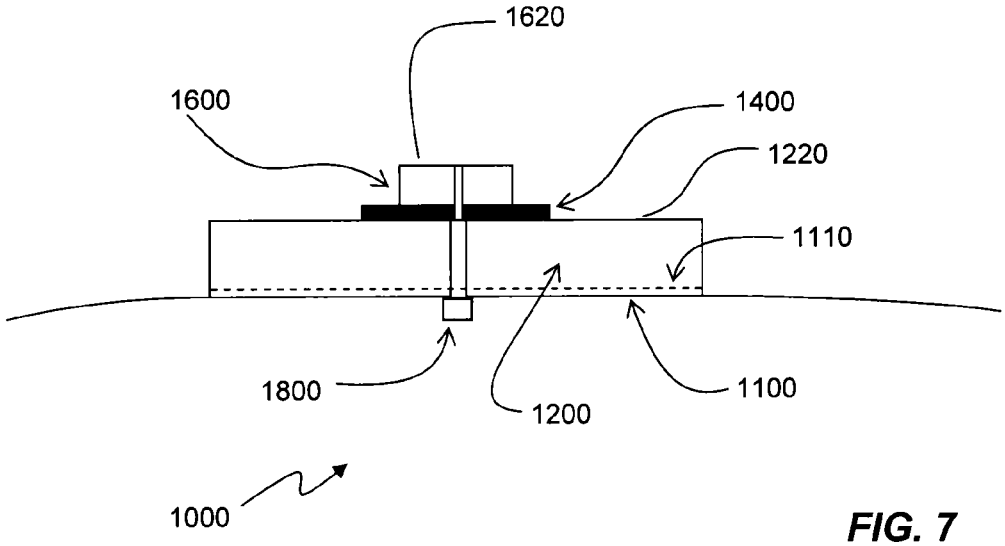
FIG. 7 illustrates one embodiment of an ultra-wideband low-profile miniaturized 3-D TW antenna consisting of two 2-D surface-mode radiators.

3-D TW Antenna with Dual 2-D Surface-Mode TW Structures, Internal Coupler, and Dual-Band Feed Network FIG. 7 shows another embodiment of a 3-D TW omnidirectional antenna, in which the 3-D TW antenna 1000 has dual 2-D surface-mode TW structures and a frequency-selective internal coupler, resulting in a low-profile platform-conformable antenna with a potential octaval bandwidth of 100:1 (e.g., 0.5-50.0 GHz) or more. It is comprised of two 2-D surface-mode TW structures 1200 and 1600, which are both similar in principle to the 2-D TW antenna 120 described in FIG. 3. The two 2-D surface-mode TW structures 1200 and 1600 are positioned concentrically with the former (1200) below the latter (1600), with a thin planar frequency-selective internal coupler 1400 between them, and with a conducting ground plane 1110 positioned below the 2-D surface-mode TW structure 1200. The larger 2-D surface-mode TW structure 1200 at the bottom covers the low band, for example 0.5-5.0 GHz, and the smaller (about 1/10 in diameter as compared with that of 1200) 2-D TW structure 1600 covers the high band, for example, 5.0-50.0 GHz or 10-100 GHz. The two 2-D surface-mode TW structures 1200 and 1600 are both fed simultaneously by the dual-band feed network 1800 illustrated in FIGS. 8A, 8B, and 8C in cross-sectional, perspective, and bottom views, respectively, the bulk of which is below conducting ground plane 1110 and above a conducting ground plane 1100 on the platform.

Figure 8A:
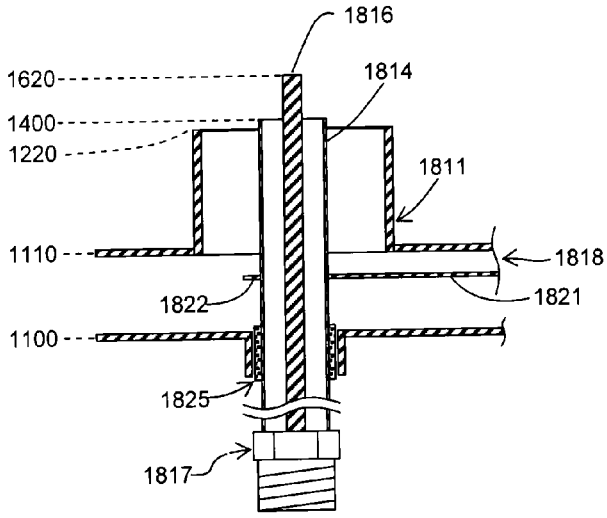
FIG. 8A shows A-A cross-sectional view of the ultra-wideband dual-band feed cable used to feed the two 2-D surface-mode radiators of FIG. 7.
Figure 8B:
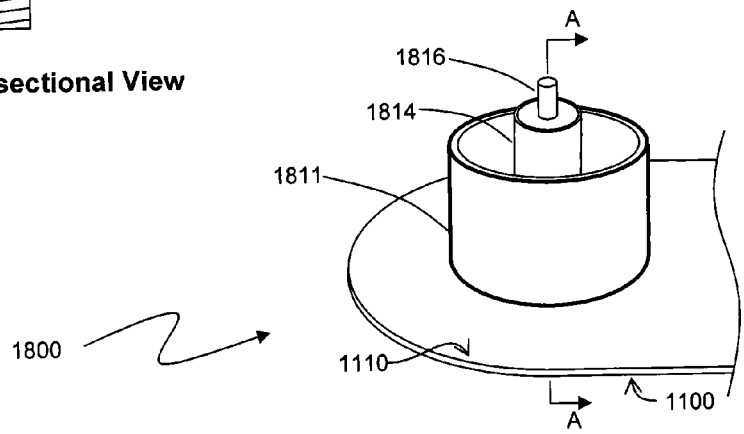
FIG. 8B shows perspective view of the ultra-wideband dual-band feed cable used to feed the two 2-D surface-mode radiators of FIG. 7.
Figure 8C:
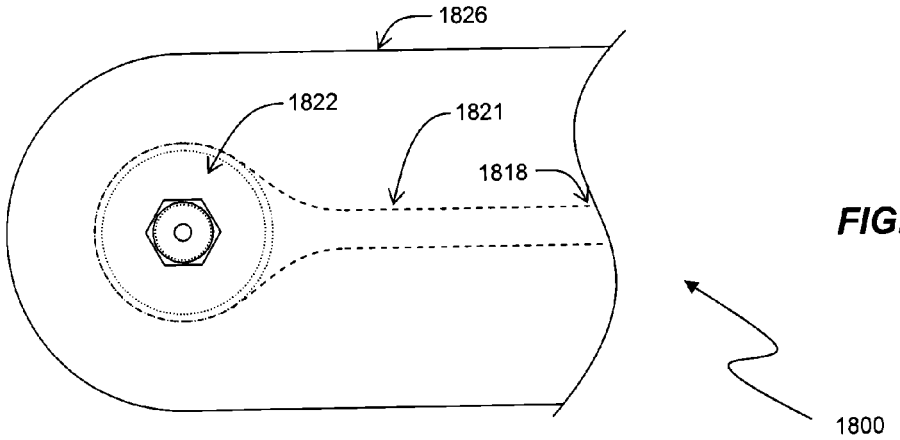
FIG. 8C illustrates bottom view of the ultra-wideband dual-band feed cable used to feed the two 2-D surface-mode radiators of FIG. 7.

The transition between these two frequency bands, which may be overlapping, be continuous, or have a large gap in between, may require some tuning and optimization by way of a thin planar frequency-selective internal coupler 1400 positioned at the interface between the two 2-D surface-mode TW structures 1200 and 1600. The frequency-selective internal coupler 1400 may be a thin planar conducting structure that can accommodate the bottom ground plane of the 2-D TW structure 1600 and the 2-D surface-mode TW radiator 1220 of the 2-D surface-mode TW structure 1200. The ultra-wideband dual-band feed network 1800 directly feeding 3-D multi-mode TW omnidirectional antenna 1000 may be a dual-band dual-feed cable assembly, the embodiments of which are illustrated in FIGS. 8A, 8B, and 8C. This ultra-wideband 3-D multi-mode TW omnidirectional antenna 1000 is capable of achieving a continuous octaval bandwidth of 100:1 or more, as explained below. Note here, however, the frequency coverage in this embodiment does not have to be continuous. For example, the present 0.5-50.0 GHz 3-D TW antenna being discussed can be readily modified to cover two separate bands, e.g., 0.5-5.0 GHz and 10-100 GHz, a frequency range of 200:1 (100 GHz/0.5 GHz) or wider.

First, the structure and functioning of the ultra-wideband dual-band dual-feed cable network assembly 1800, as illustrated in FIGS. 8A, 8B, and 8C, are as follows. Feeding the high band, for example, 5.0-50.0 GHz, is the inner cable with outer conductor 1814 and inner conductor 1816. Feeding the low band, for example, 0.5-5.0 GHz, is the outer cable with outer conductor 1811 and inner conductor 1814. The inner and outer cables share a common circular cylindrical conducting shell 1814. The center conductor 1816 of the inner cable penetrates all the way up into the 2-D radiator 1620 of the high-band 2-D surface-mode structure 1600, while the center conductor 1814 of the outer cable penetrates only up to the 2-D radiator 1220 of the low-band 2-D surface-mode structure 1200.

As shown in FIGS. 8A, 8B, and 8C, the higher band of the dual-band dual-feed cable assembly is fed through a coaxial connector 1817, and the lower band is fed through a microstrip line 1818 on ground plane 1110 with an inconspicuous connector. These two individual feed connectors can be combined into a single connector by using a combiner or multiplexer. The combination can be performed, for example, by first transforming the coaxial connector 1817 and the microstrip connector 1818 into a circuit in a printed circuit board (PCB), such as a stripline or microstrip line circuit. The combiner/multiplexer, placed between the antenna feed and the transmitter/receiver, can be enclosed within conducting walls to suppress and constrain higher-order modes inside the combiner/multiplexer.

The integration of the feed network 1800 into the 3-D multi-mode TW omnidirectional antenna 1000 is illustrated in its A-A cross-sectional view in FIG. 8A, which specifies the locations on the feed cable assembly that connect with, position at, or interface with, layers 1620, 1400, 1220, 1110, and 1100, respectively. It is worth commenting that for the low-band microstrip line feed, the high-band cable extending beyond its junction with the microstrip line toward the coaxial connector 1817 is a reactance, rather than a potential short circuit to the ground plane 1100, since the ground plane of the low-band microstrip line feed along 1822, 1821 and 1818 is 1110, and conducting plane 1100 is spaced apart from the microstrip line. Nevertheless, a thin cylindrical shell 1825 made of a low-loss dielectric material may be placed between conducting cylindrical shell 1814, which is the inner conductor of the low-band cable, and the conducting ground plane 1100 to form a capacitive shielding between them. The thin cylindrical dielectric shell 1825 removes direct electric contact between the inner conductor 1814 of the low-band cable and the conducting ground plane 1100 at the via hole, and is also thin and small enough to suppress any power leakage at low-band frequencies. A small length for the cylindrical dielectric shell 1825, as well as the sleeve for conducting ground plane 1100 at the via hole, further improve the quality of electric shielding of the low-band microstrip feed line 1818. If needed, the entire low-band microstrip feed can be encased in conducting walls to improve the integrity of the microstrip feed line 1818. Finally, a quarter-wave choke can also be placed below 1825 to reduce any resonance leakage at the via hole, if needed.

Figure 9:
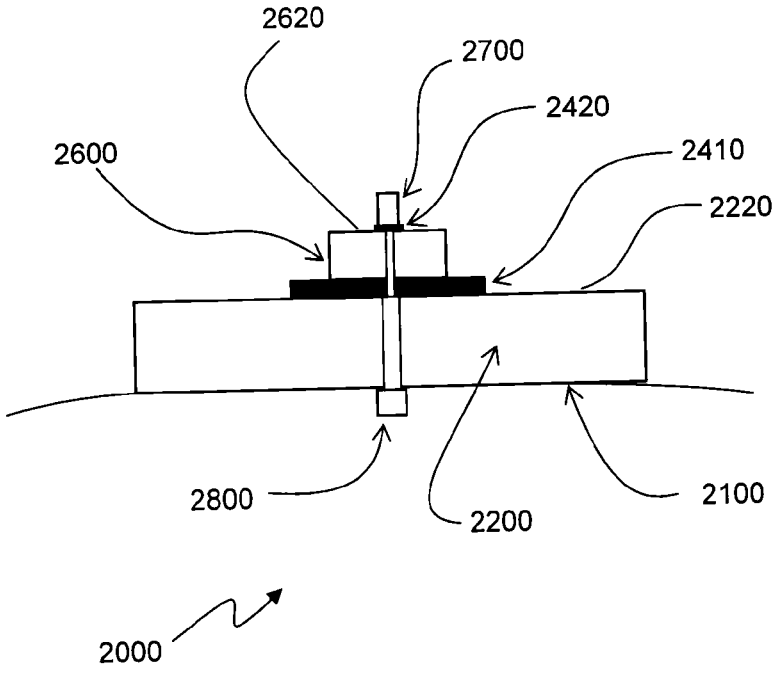
FIG. 9 depicts one embodiment of an ultra-wideband 3-D tri-mode TW omnidirectional antenna.

Tri-Mode 3-D TW Antenna with Internal/External Couplers and Dual-Band Feed Network FIG. 9 shows a 3-D tri-mode TW omnidirectional antenna 2000 that has a potential octaval bandwidth of 140:1 (e.g., 0.35-50.0 GHz). This antenna extends the lower bound of the operating frequency of the 3-D TW omnidirectional antenna 1000 with dual 2-D surface-mode TW structures, just described in FIG. 7, by adding a normal-mode TW structure 2700 on its top and a frequency-selective external coupler between them. Specifically, the 3-D tri-mode TW omnidirectional antenna 2000 is comprised of two 2-D surface-mode TW structures 2200 and 2600 as well as a normal-mode TW structure 2700 on the top. The two 2-D surface-mode TW structures 2200 and 2600 are both similar in principle to the 2-D TW antenna 120 in FIG. 3, as well as those in the 3-D TW antenna 1000. The two 2-D surface mode TW structures 2200 and 2600 are positioned concentrically and adjacent to each other with the former (2200) below the latter (2600), with a thin planar frequency-selective internal coupler 2410 at the interface between the two adjacent TW structures. A conducting ground plane 2100 is placed at the bottom of the TW structure 2200.

The larger 2-D surface-mode TW omnidirectional structure 2200 at the bottom covers the low band, for example 0.5-5.0 GHz, and the smaller (about 1/10 in diameter) 2-D TW structure 2600 covers the high band, for example, 5.0-50.0 GHz. The normal-mode TW structure 2700 on the top, excited via a thin planar frequency-selective external coupler 2420, which is placed at the interface between the two adjacent TW structures to couple and extend radiation at frequencies below those of the two 2-D surface-mode TW structures 2200 and 2600 per se (e.g., 0.5-5.0 and 5.0-50.0 GHz, respectively) to, say, 0.35-0.50 GHz. Thus the antenna 2000 has a potential octaval bandwidth of 140:1 (e.g., 0.35-50.0 GHz) or more.

The feed network 2800 is similar to the dual-band feed network 1800 employed in the 3-D TW antenna 1000. Thus, a dual 2-D surface-mode feed cable similar to 1800 illustrated in FIGS. 8A, 8B, and 8C is also employed in the feed network 2800. Feeding the high band, for example, 5.0-50.0 GHz, is a cable with outer conductor 1814 and inner conductor 1816. Feeding the two low bands, for example, 0.35-0.5 and 0.5-5.0 GHz, is the cable with outer conductor 1811 and inner conductor 1814. As can be seen, the inner and outer cables share a common circular cylindrical conducting shell 1814. Note that the center conductor 1816 of the inner cable penetrates all the way up to the 2-D radiator 2620 of the high-band 2-D surface-mode structure 2600, while the center conductor 1814 of the outer cable penetrates only up to the 2-D radiator 2220 of the low-band 2-D surface-mode structure 2200. Similarly, multiplexing and combining the high and low band signals in feed network 2800, if desired, can be implemented in the same manner as that for feed network 1800 via a circuit in a printed circuit board (PCB), such as a stripline or microstrip line circuit.

This tri-mode TW antenna 2000 has a potential continuous octaval bandwidth of about 140:1 (e.g., 0.35-50.0 GHz) or more. The tri-mode TW antenna 2000 can also be configured to cover separate bands, for example, 0.35-5.0 GHz and 10-100 GHz, thus over a frequency range of 286:1 (100 GHz/0.35 GHz) or wider.

Figure 10:
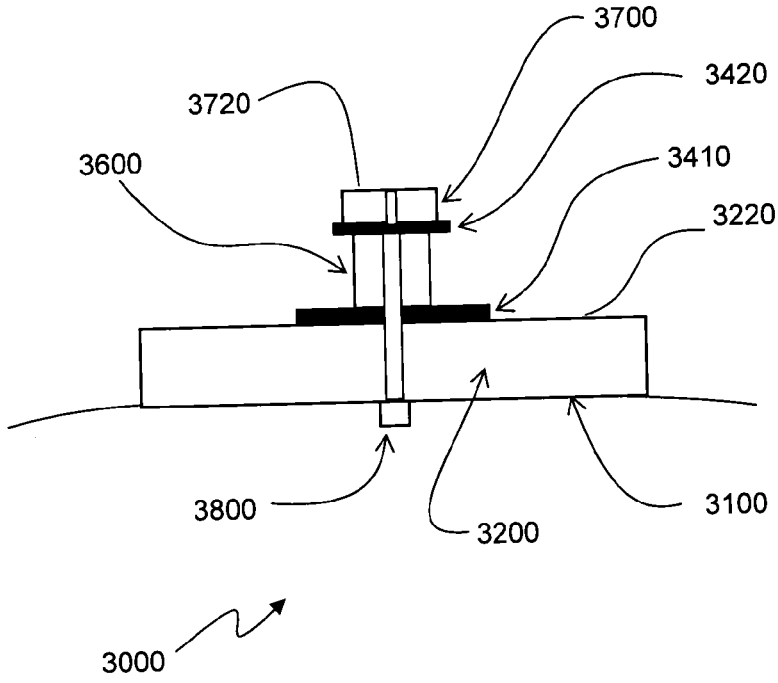
FIG. 10 depicts one embodiment of an alternate ultra-wideband 3-D tri-mode TW omnidirectional antenna.

Alternate Tri-Mode 3-D TW Antenna with Internal/External Couplers and Dual-Band Feed Network FIG. 10 shows another embodiment of a 3-D tri-mode TW omnidirectional antenna 3000 that also has a potential continuous octaval bandwidth of 140:1 (e.g., 0.35-50.0 GHz) or wider. This antenna is similar to the 3-D tri-mode TW omnidirectional antenna 2000 described in FIG. 9, but has the top two TW structures reversed. As a result, the 3-D tri-mode TW omnidirectional antenna 3000 has different physical and performance features that may be more attractive in certain applications. Specifically, the alternate 3-D tri-mode TW omnidirectional antenna 3000 is comprised of two 2-D surface-mode TW structures 3200 and 3700 for the low band and the high band, respectively, as well as a normal-mode TW structure 3600 in between. The two 2-D surface-mode TW structures 3200 and 3700 are both similar in principle to the 2-D TW antenna 120 in FIG. 3, and in particular the 3-D TW antennas 1000 and 2000, which are positioned concentrically with the former (3200) below the latter (3700). The normal-mode TW structure 3600 is positioned between the two 2-D surface-mode TW structures 3200 and 3700. In one embodiment, frequency-selective external couplers 3410 and 3420 are positioned at the interface between the 2-D surface-mode TW structures 3200 and 3700 and the normal mode TW structure 3600 as shown in FIG. 10. A conducting ground surface 3100 is placed below TW structure 3200.

The feed network 3800 is similar to dual-mode feed network 1800 employed in the 3-D TW antenna 1000, as well as 2800 employed in the 3-D TW antenna 2000. A dual 2-D surface-mode feed cable similar to 1810 illustrated in FIGS. 8A, 8B, and 8C is employed; feeding the high band, for example, 5.0-50.0 GHz, is the cable with outer conductor 1814 and inner conductor 1816. Feeding a low band, for example, 0.5-5.0 GHz, is the cable with outer conductor 1811. As shown in FIGS. 8A, 8B, and 8C, the inner and outer cables share a common circular cylindrical conducting shell 1814. Note that the inner cable penetrates the normal-mode TW structure 3600, and that the center conductor 1816 of the inner cable penetrates all the way up to the 2-D radiator 3720 of the high-band 2-D surface-mode structure 3700. Note also that the inner conductor 1814 of the outer cable penetrates only up to the 2-D radiator 3220 of the low-band 2-D surface-mode structure 3200.

The smaller 2-D TW structure 3700 covers the high band, for example, 5.0-50.0 GHz. The normal-mode TW structure 3600 is first excited by the low-band 2-D TW structure 3200 via external coupler 3410, and then the TW is coupled to the high-frequency 2-D TW structure via external coupler 3420, for frequencies below 0.5 GHz and down to 0.35 GHz or lower. As a result, this tri-mode TW antenna has a potential octaval bandwidth of 140:1 (0.35-50.0 GHz in this example) or more. Similar to the tri-mode TW antenna 2000, the tri-mode TW antenna 3000 can also be configured to have a wider multi-band capability, if needed, to cover separate bands, for example, 0.35-5.0 GHz and 10-100 GHz, thus over a frequency range of 286:1 (100 GHz/0.35 GHz) or wider.

Similarly, multiplexing and combining of high and low band signals in feed network 3800, if desired, can be implemented in the same manner as that for feed network 1800 via a circuit in a printed circuit board (PCB), such as a stripline or microstrip line circuit.

Figure 11:
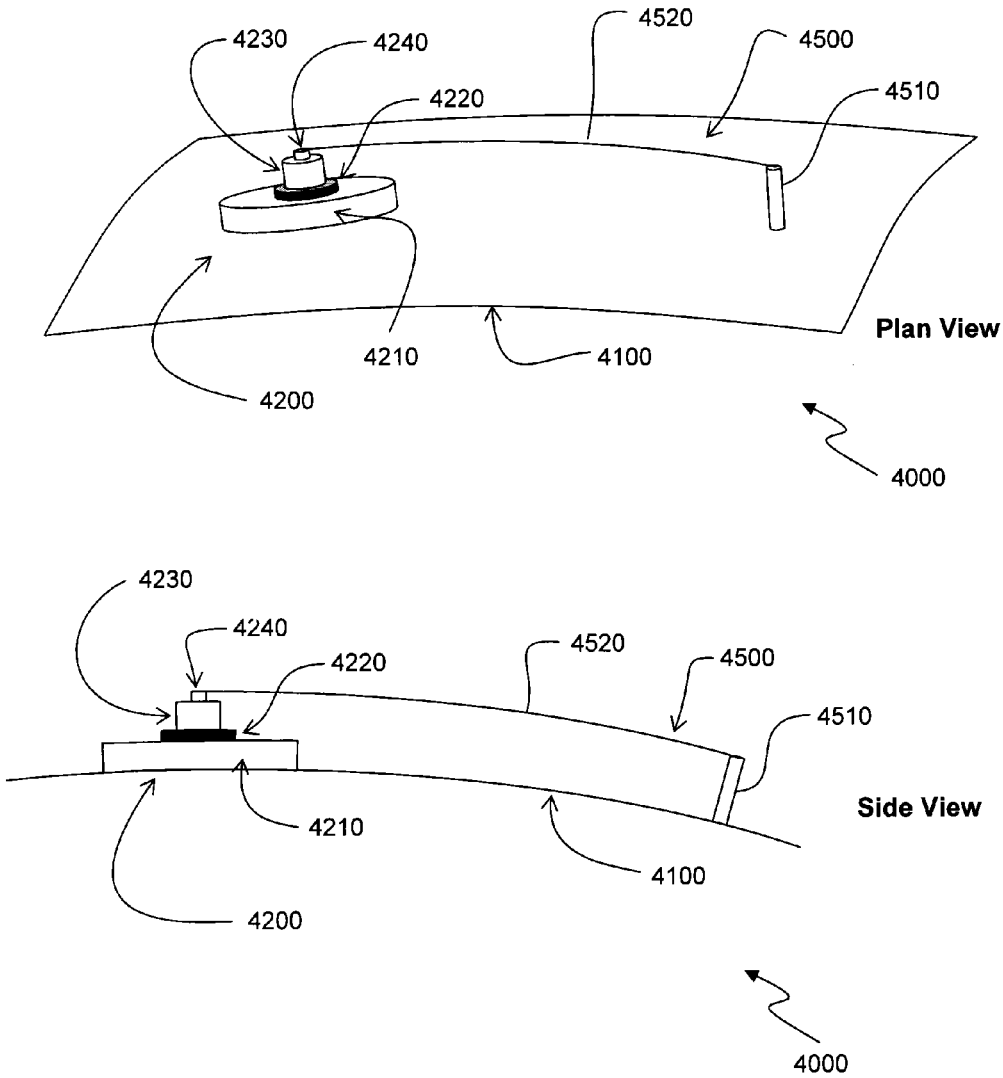
FIG. 11 depicts one embodiment of a multi-mode 3-D TW antenna covering ultra-wideband and separate distant low-frequencies.

Multi-Mode 3-D TW Antenna Covering Ultra-Wideband and Separate Distant Low-Frequencies In some applications, it is desirable to cover some separate distant low frequencies, say, below 100 MHz, in addition to ultra-wideband coverage at higher common frequencies. For example, at 100 MHz or below, where the wavelength is 3 m or longer, any wideband antenna may be too large for the platform under consideration or the user's perspective; yet some narrowband coverage at these low frequencies may be desired and even adequate. Under these circumstances, a solution using the multi-mode 3-D TW omnidirectional antenna approach is depicted in FIG. 11, as antenna ensemble 4000.

In this embodiment, the antenna is mounted on a generally flat conducting surface 4100 on the platform; if the surface of the platform is non-metal, the conducting property can be provided by adding a thin sheet of conducting material by a mechanical or chemical process. The conducting ground surface 4100 covers a surface area on the platform, having dimensions at least as large as the projection of the 3-D TW antenna on the surface of the platform. Antenna ensemble 4000 is primarily comprised of two parts: a 3-D multi-mode TW omnidirectional antenna 4200 and a transmission-line antenna 4500, connected with each other.

The 3-D multi-mode TW omnidirectional antenna 4200 can be in any form or combination that has been presented earlier in this invention in various forms, but preferably has a normal-mode TW structure 4230, generally positioned on top. The normal-mode TW structure 4230 is coupled to a 1-D TW transmission line antenna 4500 via a frequency-selective low-pass coupler 4240, which is a low-pass filter that passes the desired individual signals at separate distant low frequencies, say, 40 MHz and 60 MHz. The low-pass coupler 4240 can be a simple inductive coil optimized for interface between TW structures 4200 and 4500.

The transmission-line antenna 4500 is a 1-D TW antenna, which has one or more tuned radiators 4510, each of which has a reactance that brings the radiator into resonance and impedance match with the rest of the antenna ensemble 4000. The transmission-line section of 4500 does not have to be a straight line. For instance, it can be curved to minimize the surface area needed for its installation. The bandwidth and efficiency of the transmission-line antenna 4500 can be enhanced by using a wider or fatter structure for both the transmission-line section 4520 and the vertical radiator 4510. The transmission-line antenna 4500 can have a reactive tuner above or below the ground surface 4100 to obtain resonance at one or more desired frequencies at distant low frequency bands.

This tri-mode TW antenna ensemble 4000 can achieve a continuous octaval bandwidth of 140:1 or more similar to those achievable by TW antennas 100, 2000, and 3000. It can also be configured to have a wider multi-band capability, if needed, to cover one or more separate bands at much lower frequencies below, for example, at 0.05 GHz, thus over a frequency range of 2000:1 (100 GHz/0.05 GHz) or wider.

Many variations and modifications may be made to the above-described embodiments of the invention without departing substantially from the spirit and principles of the invention. All such modifications and variations are intended to be included herein within the scope of the present invention.

Theoretical Basis of the Invention

The platform-compatible 3-D TW omnidirectional antenna in this invention can achieve a continuous octaval bandwidth of up to 140:1 or more. It can also achieve a multi-band capability, if needed, to cover one or more separate bands at much lower frequencies below, for example, at 0.05 GHz, over a frequency range of 2000:1 (100 GHz/0.05 GHz) or wider. The antenna can achieve a fairly constant radiation resistance of approximately 50 ohms or, if needed, the characteristic impedance of any another common coaxial cable throughout its operating frequencies. Additionally, the antenna can also achieve a small reactance relative to its radiation resistance throughout its operating frequencies. The theoretical basis for such ultra-wideband radiation TW apertures is described as follows, beginning with some needed mathematical formulation.

Without loss of generality, the theory of operation for the present invention can be explained by considering the case of transmit; the case of receive is similar on the basis of reciprocity. The time-harmonic electric and magnetic fields, E and H, due to the sources on the surface of the radiator, denoted by S, can be represented as those due to the equivalent electric and magnetic currents, $J_s$ and $M_s$, on the surface S given by $$M_s = -n \times E \text{ on } S \tag{2a}$$

$$J_s = n \times H \text{ on } S \tag{2b}$$

The electromagnetic fields outside the closed surface S is given by $$H(r) = \int_S \left[ -j\omega\varepsilon_o M_s(r')g + J_s(r') \times \nabla' g + \frac{1}{j\omega\mu_o} \nabla'_s \cdot M_s(r') \nabla' g \right] ds' \quad \text{outside S} \tag{3}$$

where g is the free-space Green's function given by $$g = g(r, r') = \frac{e^{-jk|r-r'|}}{4\pi|r-r'|} \tag{4}$$

where $k=2\pi/\lambda$ and $\lambda$ is the wavelength of the TW. $\in_o$ and $\mu_o$ are the free-space permittivity and permeability, respectively. And $\omega=2\pi f$, where f is the frequency of interest.

The unprimed and primed (') position vectors, r and r', with magnitudes r and r' refer to field and source points, respectively, in the source and field coordinates. (All the "primed" symbols refer to the source). The symbol $\nabla_s'$ denotes a surface gradient operator with respect to the primed (') coordinate system.

For the surface-mode TW radiator consisting of an array of slots, the region of the surface radiator is fully represented by an equivalent magnetic surface current $M_s$. As for the region over the surface of the platform, there is only an equivalent electric surface current $J_s$ if the platform surface is conducting. For the surface area on the platform that is nonconducting, both electric and magnetic equivalent surface currents, $J_s$ and $M_s$, generally exist. For the normal-mode TW radiator, the equivalent electric surface current $J_s$ exists, and the magnetic equivalent surface current $M_s$ vanishes.

The time-harmonic fields in the far zone are given by Eq. (3). In the far zone that is of interest to antenna property, the fields are plane waves with the following relationship between electric and magnetic fields:

$$E(r)=-\eta\hat{r}\times H(r) \text{ in the far zone} \tag{5}$$

where $\eta$ is the free-space wave impedance, equal to $\sqrt{\mu_o/\epsilon_o}$ or $120\pi$. Note here that the sources, fields, and the Green's function involved here, according to Eqs. (2) through (5), are all complex vector quantities. Therefore, radiation will be effective if the integrand in Eq. (3) is substantially in phase in the desired directions in the far zone; and the radiation must also yield a useful radiation pattern, being omnidirectional in the present case. For efficient radiation, good impedance matching is also essential. Based on antenna theory, and specialized to the present problem in Eqs. (3) and (4), a useful antenna radiation pattern is directly related to its source currents. Therefore, it is advantageous to design the TW radiators from known broadband TW configurations.

Referring to FIGS. 2 and 3, a surface-mode TW is launched from the feed network 180 of the conformal low-profile TW antenna 100, and propagates radially outwardly from the $U_n$ axis. While the TW propagates radially along the TW structure 120, radiation takes place on the surface-mode TW radiator 125, such as the array of slots 221 in FIG. 4, in a circular radiation zone. For any frequency in the antenna's operating range, the circular radiation zone is at a radius similar to that of an efficient annular slot. The TW propagates radially outwardly from the $U_n$ axis with minimal reflection as the TW structure 120 has a properly designed impedance matching structure placed between the surface-mode radiator 125 and the ground surface 110 over an ultra-wide bandwidth (for example, 10:1 in octaval bandwidth). For embodiments of this invention containing two surface-mode TW structures, radiation in the individual band of operation from one surface-mode TW structure is not affected adversely by the other surface-mode TW structure in light of Eq. (3) and the use of frequency-selective internal couplers between them to suppress out-of-band coupling.

At frequencies lower than this ultra-wide bandwidth, the TW power cannot radiate effectively via surface-mode radiator 125. In this case, the TW power is coupled externally to the normal-mode TW structure 160 and the ground plane 110 via a frequency-selective external coupler 140. It is worth pointing out that the stacking of the TW antennas, with judicial use of properly designed frequency-selective external and internal couplers, would broaden the bandwidth without disturbing each other's in-band performance. With the external coupler, the TW structure 120 can function undisturbed in its inband (individual band) of operation, for example, 1-10 GHz. At its out-of-band frequencies immediately below (below 1 GHz in the example), the TW power cannot be radiated from the TW structure 120 and is coupled externally to the normal-mode TW structure 160 via the external coupler 140. As a result, the TW power then radiates over a medium bandwidth (for example, 1.3:1) over the frequency range below that of the surface-mode TW radiator 125 per se. Note here that RF power is also coupled from the TW radiators to the ground plane 110 and, if the platform surface is also conducting, to the platform surface, thus beneficially enlarging the effective size of the antenna and consequentially circumventing the Chu limit confined by the TW structures per se.

Figure 12:
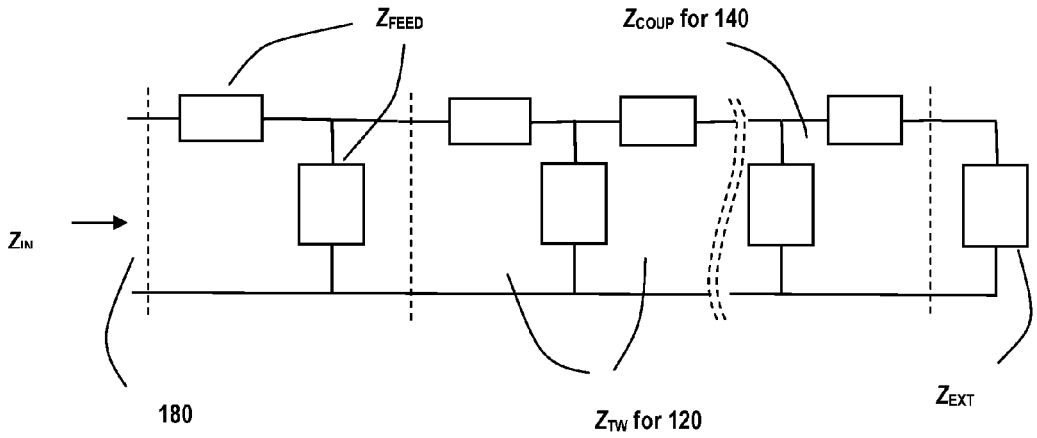
FIG. 12 shows one embodiment of an equivalent transmission-line circuit for the feed network for the 3-D multi-mode TW antenna.

In TW structure 120, propagation of the TW from the feed network 180 to free space is represented by the equivalent transmission-line circuit in FIG. 12. Here $Z_{IN}$ is the input impedance at the connector of the feed network 180, usually 50 ohms. $Z_{FEED}$ is the distributed impedance matching structure employed to match the input impedance of the feed network 180 with all other structures further down, as represented by the transmission-line circuit, which also includes $Z_{TW}$ for the TW structure 120, $Z_{COUP}$ for the impedance of the frequency-selective external coupler 140, and $Z_{EXT}$ for the impedance of the exterior region including ground plane 110, normal-mode TW structure 160, the platform 30, and the free space.

Impedance matching must be achieved over all of the operating bandwidths. Note that FIG. 12 depicts an equivalent transmission-line circuit for the dominant mode, with the guided wave discontinuities represented by lumped elements. General impedance matching techniques for multi-stage transmission lines and waveguides are known in the art.

For the case involving two internally coupled 2-D dual surface-mode TW radiators, such as the antenna 1000 depicted in FIG. 7, the enabling elements are the thin planar frequency-selective internal coupler 1400 and the dual-band feed network 1800 in FIGS. 8A, 8B, and 8C, as well as their composition. In particular, the ultra-wideband dual-band dual-feed cable network 1800 enables the combination of two 2-D dual surface-mode TW radiators over a continuous octaval bandwidth of 100:1 (e.g., 0.5-50.0 GHz) or more, as explained in details earlier. Expansion of the continuous octaval bandwidth to 140:1 or more results from the combination of these two basic embodiments, employed in antenna 100 and antenna 1000, in a coordinated manner using both external and internal couplers and in using both normal-mode and surface-mode TW radiating structures. Built on these basic embodiments, 3-D TW antenna can also achieve a multi-band capability, if needed, to cover one or more separate bands at much lower frequencies below, for example, at 0.05 GHz, over a frequency range of 2000:1 (100 GHz/0.05 GHz) or wider.

Experimental Verification

Experimental verification of the fundamental principles of the invention has been carried out satisfactorily. For the combination of normal-mode and surface-mode TW radiators using an external coupler, as depicted in FIG. 3, several breadboard models were designed, fabricated and tested on their VSWR, radiation pattern, and gain. Measured data showed that a bandwidth of over 14:1 and volume, weight, cost reduction by a factor of about 3 to 6, were achieved, as compared with a standard SMM antenna, which has a 10:1 gain bandwidth.

Figure 13:
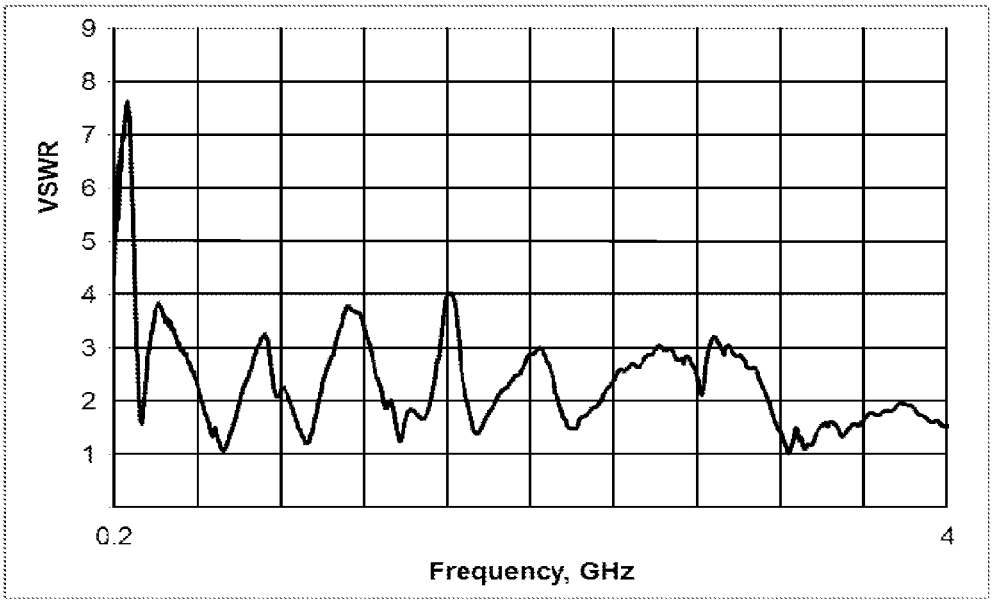
FIG. 13 shows measured VSWR for the antenna in FIG. 7 from the two input terminals, covering an octaval bandwidth of 100:1, over 0.2-20.0 GHz.
Figure 13:
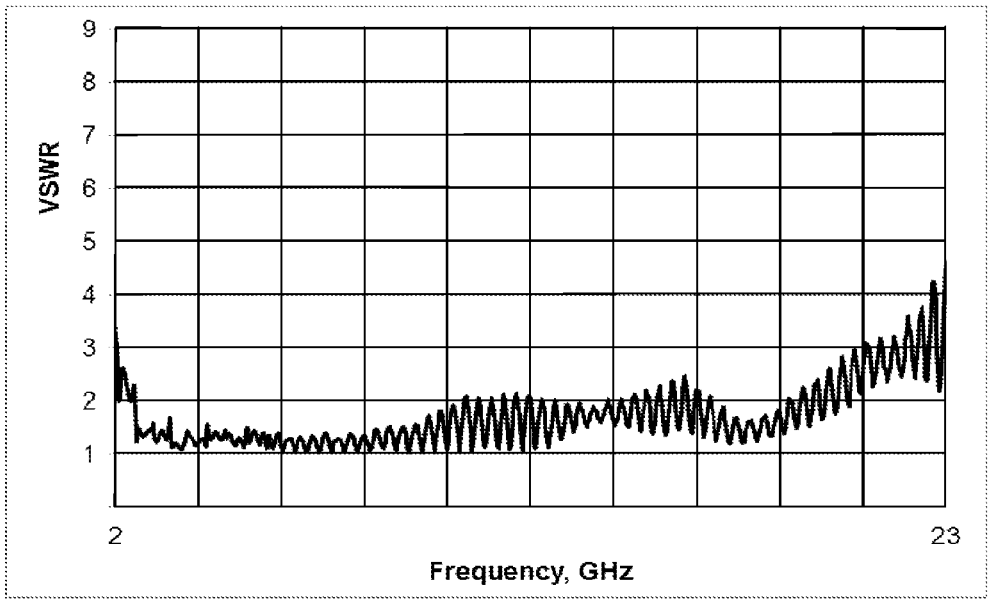
Figure 14:
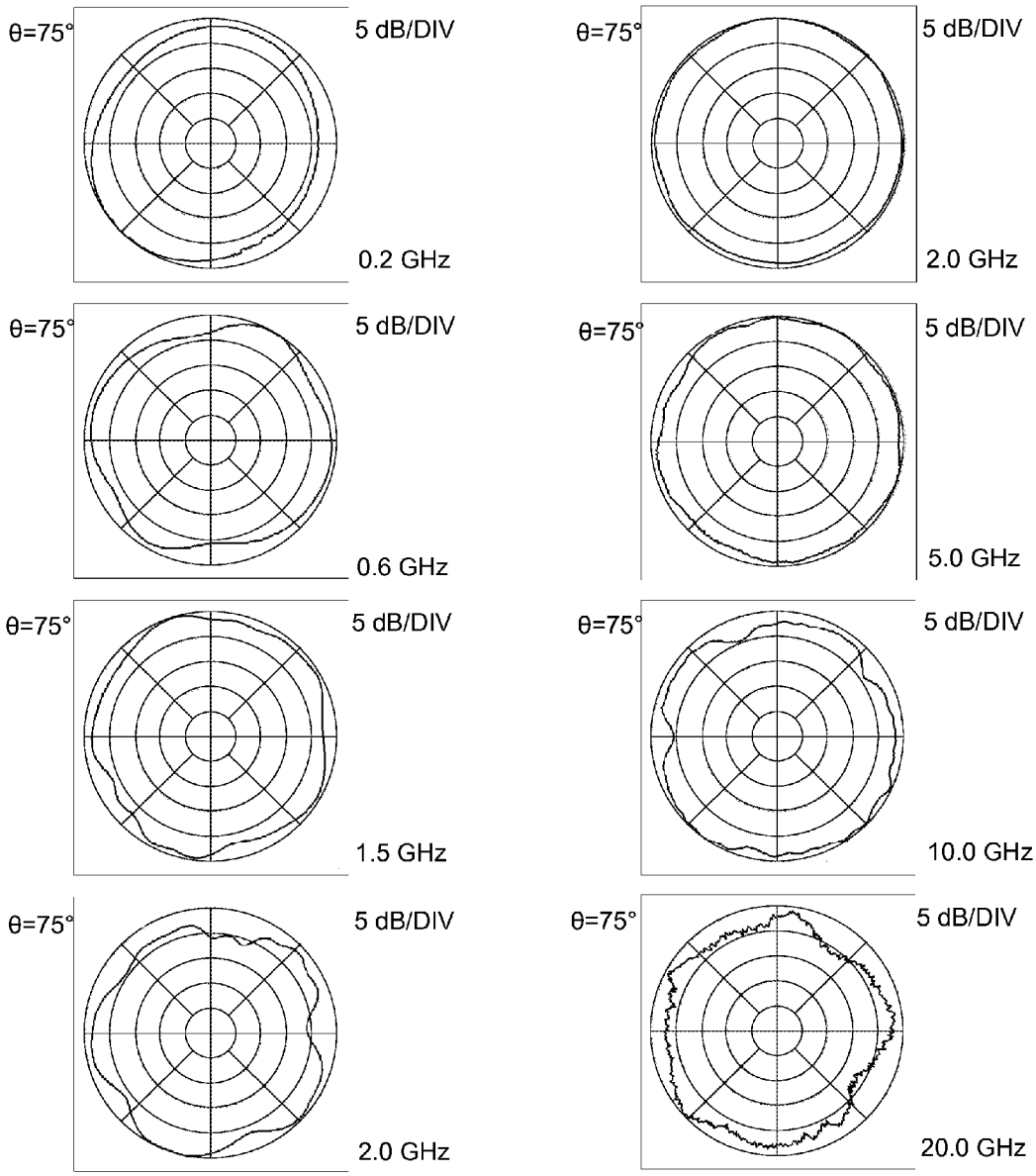
FIG. 14 shows typical measured radiation patterns of the antenna in FIG. 7, covering an octaval bandwidth of 100:1, over 0.2-20.0 GHz.

For the combination of two surface-mode TW radiators, as depicted in FIG. 7 and FIGS. 8A, 8B, and 8C, a breadboard model was successfully designed, fabricated, and tested to demonstrate a continuous octaval bandwidth of 100:1, over 0.2-20.0 GHz. In this model, there are two output terminals, one for a high band of 2-20 GHz and the other for the low band of 0.2-2.0 GHz, which can be combined into a single terminal, if needed, by using a broadband combiner/splitter or diplexer. FIG. 13 shows measured VSWR from the two terminals, covering about 0.2-23.0 GHz, which is generally under 2:1; the results are quite satisfactory since this is a crude breadboard model not yet optimized. FIG. 14 shows measured azimuth radiation patterns, at a fixed elevation angle of about 15° above the ground plane or the surface of the platform, over 0.2-20.0 GHz antenna. The data collectively demonstrated a continuous octaval bandwidth of 100:1. Note here, however, the frequency coverage in this embodiment does not have to be continuous. For example, the 3-D TW antenna can be readily modified, based on the frequency scaling theorem in electromagnetics, to cover, for example, 0.5-5.0 GHz and 10-100 GHz.

Observation on the measured data, not shown here, indicates that a bandwidth much higher than 100:1 is also feasible. These data also indicate, though indirectly, that the combination of two surface-mode TW radiators and a normal-mode TW radiator, as depicted in FIG. 9 and FIG. 10, can lead to a continuous octaval bandwidth of 140:1 or more.

The invention claimed is:

1. An omnidirectional antenna comprising:

a plurality of traveling-wave (TW) structures comprising at least one ultra-wideband low-profile two-dimensional (2-D) surface-mode TW structure, the plurality of TW structures being adjacent to each other, and wherein the surface-mode TW structure is excited in mode-0 and comprises a 2-D surface-mode TW radiator for omnidirectional radiation, the 2-D surface-mode TW structures being further configured to have a diameter less than $\lambda_L/2$ and a thickness less than $\lambda_L/10$, where $\lambda_L$ is the free-space wavelength at the lowest frequency of operation of the 2-D surface-mode TW structures;

a frequency-selective coupler placed in between adjacent TW structures;

a feed network, wherein the feed network excites the plurality of TW structures in mode-0; and a conducting ground surface, wherein the conducting ground surface is of a canonical shape, the conducting ground surface further being positioned at a bottom side of the antenna, and having a surface area covering at least the projection of the antenna.

2. The omnidirectional antenna as claimed in claim 1, wherein the antenna is an ultra-wideband miniaturized low-profile omnidirectional multi-mode three-dimensional (3-D) TW antenna.

3. The omnidirectional antenna as claimed in claim 1, wherein each of the plurality of TW structures covers a separate frequency range so as to cover an ultra-wideband range of frequencies for the antenna.

4. The omnidirectional antenna as claimed in claim 1, wherein at least two of the plurality of TW structures are stacked one on top of the other, and are substantially symmetrical about a center axis.

5. The omnidirectional antenna as claimed in claim 1, wherein at least one of the 2-D surface-mode TW structures of the plurality of TW structures is of a slow-wave (SW) type and has a diameter that is less than $\lambda_L/(2\times SWF)$, wherein SWF is a Slow Wave Factor for the 2-D surface-mode TW structure of SW type.

6. The omnidirectional antenna as claimed in claim 1, wherein the plurality of TW structures comprises an ultra-wideband low-profile 2-D surface-mode TW structure placed above the conducting ground surface, and a normal-mode TW structure stacked above the ultra-wideband low-profile 2-D surface-mode TW structure, the normal-mode TW structure being electromagnetically coupled with the surface-mode TW structure by an external coupler.

7. The omnidirectional antenna as claimed in claim 1, wherein the plurality of TW structures comprises a low-frequency ultra-wideband low-profile 2-D surface-mode TW structure positioned above the conducting ground surface, a high-frequency ultra-wideband low-profile 2-D surface-mode TW structure positioned above the low-frequency ultra-wideband low-profile 2-D surface-mode TW structure, and wherein the feed network comprises a dual-connector dual-band coaxial cable ensemble which feeds the low-frequency ultra-wideband low-profile 2-D surface-mode TW structure and the high-frequency ultra-wideband low-profile 2-D surface-mode TW structure.

8. The omnidirectional antenna as claimed in claim 7, further comprising a normal-mode TW structure being positioned above the high-frequency 2-D surface-mode TW structure, and wherein a frequency-selective external coupler is placed between the normal-mode TW structure and the high-frequency surface-mode TW structure to facilitate electromagnetic coupling.

9. The omnidirectional antenna as claimed in claim 1, wherein the plurality of TW structures further comprises:

a low-frequency ultra-wideband low-profile 2-D surface-mode TW structure being positioned above the conducting ground surface;

a normal-mode TW structure stacked above the low-frequency ultra-wideband low-profile 2-D surface-mode TW structure;

a high-frequency ultra-wideband low-profile 2-D surface-mode TW structure stacked above the normal-mode TW structure; and wherein a frequency-selective external coupler is placed in between the normal-mode TW structure and each of the two 2-D surface-mode TW structures, and wherein the feed network comprises a dual-connector dual-band coaxial cable ensemble that feeds each of the two 2-D surface-mode TW structures and passes through a center portion of the normal-mode TW structure.

10. The omnidirectional antenna as claimed in claim 1, wherein the 2-D surface-mode TW radiator is a planar multi-arm Archimedean spiral with mode-0 excitation.

11. The omnidirectional antenna as claimed in claim 1, wherein the 2-D surface-mode TW radiator is a planar multi-arm equiangular spiral with mode-0 excitation.

12. The omnidirectional antenna as claimed in claim 1, wherein the 2-D surface-mode TW radiator is a planar zigzag structure with mode-0 excitation.

13. The omnidirectional antenna as claimed in claim 1, wherein the 2-D surface-mode TW radiator is a planar array of slots with mode-0 excitation.

14. The omnidirectional antenna as claimed in claim 1, wherein the 2-D surface-mode TW radiator is a planar self-complementary structure with mode-0 excitation.

15. A multi-mode three-dimensional (3-D) low-profile traveling-wave (TW) omnidirectional antenna covering one or more ultra-wide bandwidths at high frequencies and separate distant low-frequency bands, and conforming to a surface of a platform, the 3-D TW antenna comprising:

a conducting ground surface, which is in the form of a canonical shape, wherein the conducting ground surface conforms to a portion of the surface of a platform, the conducting ground surface being placed under the 3-D TW antenna and having a set of dimensions at least as large as those of the surface area of the 3-D TW antenna projected on the surface of the platform;

a plurality of TW structures on top of the conducting ground surface, wherein each of the TW structure covers separate frequency band so as to enable the omnidirectional antenna to span in aggregate multiple bands over an ultra-wide range of frequencies, wherein the TW structures include at least one ultra-wideband low-profile 2-D surface-mode TW structure, and wherein the ultra-wideband low-profile 2-D surface-mode TW structure has a diameter less than $\lambda_L/2$, where $\lambda_L$ is the free-space wavelength at the lowest frequency of operation of the 2-D surface-mode TW structures, the TW structures being adjacent to each other and stacked above the conducting ground surface;

a frequency-selective coupler placed in between adjacent TW structures;

at least one-dimensional (1-D) transmission-line antenna positioned adjacent to the plurality of TW structures, wherein the 1-D transmission-line antenna is coupled to a top side of the plurality of TW structures via a low-pass coupler to cover a plurality of separate distant low frequencies; and a feed network matching the impedances of the TW structures and the 1-D transmission-line antenna with the impedance of an external connector.

16. The 3-D TW antenna as claimed in claim 15, wherein one of the 2-D surface-mode TW structures is of a slow-wave type, and has a surface area smaller than a circular surface $\lambda_L/(2\times SWF)$ in diameter, wherein $\lambda_L$ is the free-space wavelength at the lowest frequency of operation, and SWF is the Slow Wave Factor, of this 2-D surface-mode TW structure.

17. An omnidirectional antenna comprising:

a conducting ground surface being positioned at a bottom side of the antenna, a plurality of traveling-wave (TW) structures on top of the conducting ground surface and covering a range of operating frequencies, wherein each TW structure covers a separate frequency band;

a frequency-selective coupler placed in between adjacent TW structures; and a feed network matching an impedance of the TW structures with an impedance of an external connector.

18. The omnidirectional antenna of claim 17, wherein the antenna is an ultra-wideband miniaturized low-profile omnidirectional multi-mode three-dimensional TW antenna covering a continuous span of frequencies.

19. The omnidirectional antenna of claim 17, wherein at least one of the TW structures is an ultra-wideband low-profile two-dimensional (2-D) surface-mode TW structure with a diameter less than $\lambda_L/2$, where $\lambda_L$ is the free-space wavelength at the lowest operating frequency of the antenna.

20. The omnidirectional antenna of claim 17, wherein the TW structures are stacked vertically, wherein each of the TW structures is symmetrical about a center axis of the antenna.

21. The omnidirectional antenna of claim 17, wherein the TW structures are stacked symmetrically about an axis normal to the ground surface.

22. The omnidirectional antenna of claim 17, wherein the plurality of TW structures comprises an ultra-wideband low-profile 2-D surface-mode TW structure and an ultra-wideband low-profile normal-mode TW structure.

23. The omnidirectional antenna of claim 17, wherein at least one of the plurality of ultra-wideband low-profile 2-D surface-mode TW structures is parallel and conformal to the conducting ground surface, and wherein the conducting ground surface is of a canonical shape.

24. The omnidirectional antenna of claim 17, wherein at least one of the plurality of ultra-wideband low-profile 2-D surface-mode TW structures has a surface that is elongated.

* * * * *